US006547349B2

(12) United States Patent
Sessa et al.

(10) Patent No.: US 6,547,349 B2
(45) Date of Patent: Apr. 15, 2003

(54) METHOD FOR PRODUCING MULTI-COMPARTMENT REFRIGERATORS

(75) Inventors: Luigi Sessa, Comabbio (IT); Giorgio Giudici, Lonate Pozzolo (IT)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/898,976

(22) Filed: Jul. 3, 2001

(65) Prior Publication Data

US 2002/0002839 A1 Jan. 10, 2002

(30) Foreign Application Priority Data

Jul. 5, 2000 (IT) ..... MI00A1515

(51) Int. Cl.[7] ..... A47B 96/04
(52) U.S. Cl. ..... 312/352; 312/405
(58) Field of Search ..... 312/352, 400, 312/401, 403, 404, 405, 407, 236; 62/440, 441

(56) References Cited

U.S. PATENT DOCUMENTS 3,601,463 A * 8/1971 Watt ..... 312/407 X
4,573,325 A * 3/1986 Chiu et al. ..... 62/129
4,638,644 A * 1/1987 Gidseg ..... 62/329
4,876,860 A 10/1989 Negishi ..... 62/179
5,577,822 A 11/1996 Seon ..... 312/404
5,694,789 A * 12/1997 Do ..... 312/405 X
6,315,039 B1 * 11/2001 Westbrooks, Jr. et al. .. 312/236 X

FOREIGN PATENT DOCUMENTS

GB 785901 * 11/1957 ..... 312/401
GB 2072822 A 10/1981

OTHER PUBLICATIONS

European Search Report EPO 01 11 440 Dated Oct. 11, 2001.

* cited by examiner

*Primary Examiner*—James O. Hansen
(74) *Attorney, Agent, or Firm*—Robert O. Rice; Stephen Krefman; Thomas J. Roth

(57) ABSTRACT

A method for varying the volumn of a refrigerator cabinet into two different configurations, by providing each of the two configurations with a substantially equal static cabinet, two deep doors of unequal height outwardly closing two end compartments and an intermediate compartment, and a frontal divider selectively fixable to the static cabinet in two different positions, on the basis of which a different selected end, compartment is increased in volume by its connection to the deep door of greater height.

20 Claims, 2 Drawing Sheets

METHOD FOR PRODUCING MULTI-COMPARTMENT REFRIGERATORS

BACKGROUND OF THE INVENTION

1. Field of the Invention

The present invention relates to a method for producing multi- compartment upright refrigerators, i.e. provided with several preservation compartments at different temperatures.

2. Description of the Related Art

Refrigerators provided with more than two preservation compartments at different temperatures are known in the most varied forms. The compartments are generally three in number: a freezer compartment, a refrigeration compartment and a crisper or drinks compartment for preserving products at a temperature higher than those of the other two compartments. Some of these refrigerators have the three compartments situated one above the other, each being closed towards the outer environment by its own door. There are also three- compartment refrigerators in which one of the compartments is inside another, these two compartments being closed towards the outside by a common door, so that the refrigerator presents two outside doors.

Refrigerators are also known in which the doors are of relatively considerable depth such that for example the preservation compartment, with the door closed, has a depth 15–20% of which is occupied by the door. The purpose is to give the user better visibility of, and better access to, the refrigerator contents.

Notwithstanding the crowded state of the refrigerator art, much remains still to be done in reducing production costs by standardizing the main refrigerator components, while at the same time satisfying the aesthetic and functional requirements of the clientele.

SUMMARY OF THE INVENTION

An object of the present invention is to provide a method for producing refrigerators of the indicated type which is able to assume two different configurations by using substantially the same basic components.

This and further objects which will be more apparent from the ensuing detailed description are attained by a method in accordance with the teachings of the accompanying claims.

BRIEF DESCRIPTION OF THE DRAWINGS

The invention will be better understood from the detailed description of a preferred embodiment thereof given hereinafter by way of non-limiting example with reference to the accompanying drawing, in which.

DESCRIPTION OF THE PREFERRED EMBODIMENT

Figure 1:
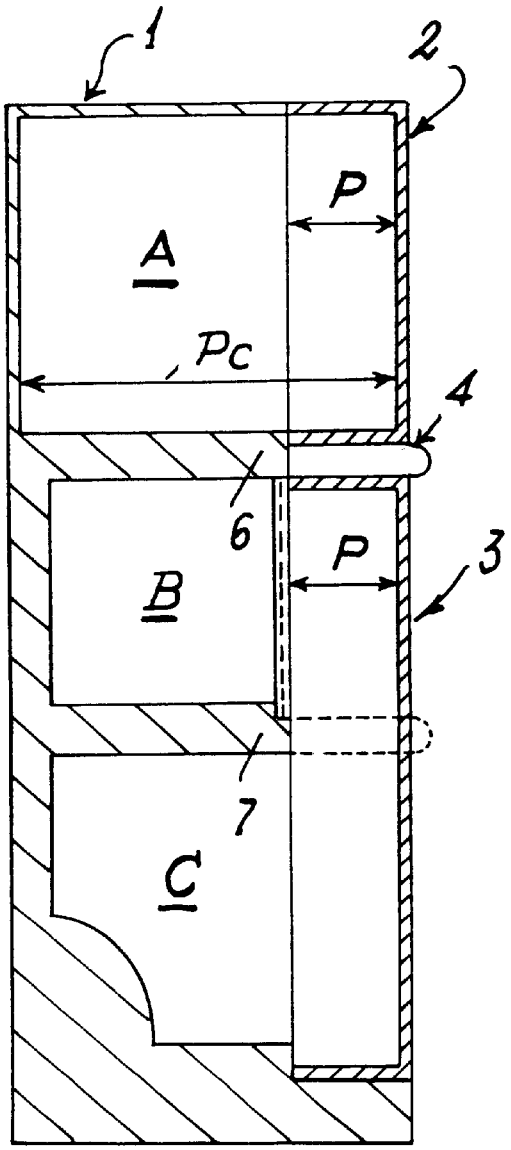
FIG. 1 is a schematic vertical section through a refrigerator of the invention in a first combination of components.
Figure 2:
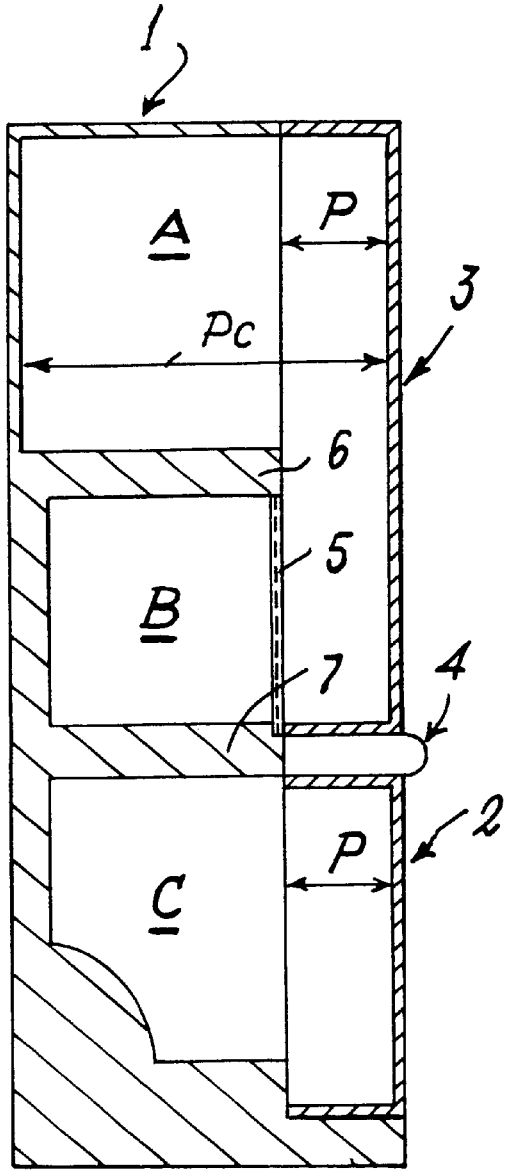
FIG. 2 is a schematic vertical section through a refrigerator of the invention in a second combination of basic components.
Figure 3:
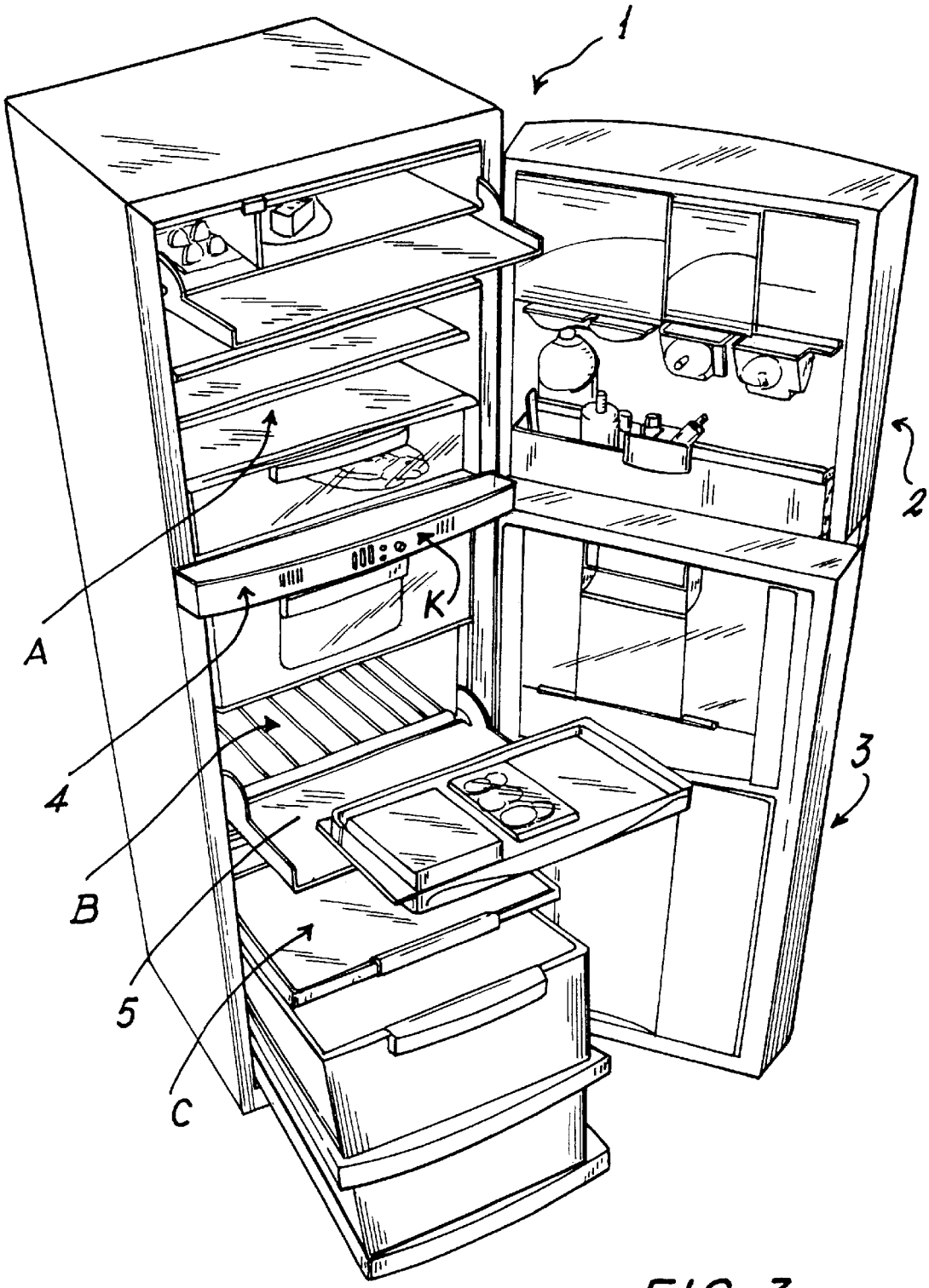
FIG. 3 id a perspective view of an embodiment of the refrigerator in the version of FIG. 1.

The two refrigerator versions reproduced in FIGS. 1 and 2 have the same basic components of the relative cabinet in common, namely the static part 1, two doors 2 and 3 of different longitudinal dimensions for closing the cabinet towards the outside, and a front divider 4 between the two doors, which also forms the refrigerator control panel in the sense of containing: the refrigerator controls including manual controls K (FIG. 3) (for example for temperature, humidity etc.), display devices for operating conditions, antimoisture filters, possible air circulation fans, the electronic control circuitry for the refrigerator, etc.

The doors are hinged in conventional manner to the cabinet 1 and to the divider 4.

The static part 1, constructed by traditional technology, comprises three superposed compartments, namely a refrigeration compartment A (scheduled for example for temperatures from 0 to 3° C.); a freezer compartment B (scheduled for temperatures less than −18° C.) and a preservation compartment C (acting for example as a drinks holder or crisper at a temperature of 4–5° C.).

The two doors 2, 3 are deep (distance P) and of substantially equal depth. The door depth P is chosen to contribute at least 30% (preferably 353–40%) of the overall depth Pc that the refrigeration compartment A assumes with the door closed.

The divider 4 is secured in any known manner to the static part 1, for example by screw means. In the version of FIG. 1 the divider 4 is connected the baffle 6 which separates the two compartments A and B, whereas in the version of FIG. 2 it is connected to the baffle 7 which separates the two compartments B and C.

The freezer compartment B is provided with its own door 5 represented by a flap rotatable about a lower horizontal axis (although hinging on a vertical axis is not to be excluded).

In the version of FIG. 1, the volume available for refrigeration is given by the sum of the volume of compartment A present in the cabinet 1 and the volume available in the door 2.

The volume of compartment C is increased by the volume relative to the door 3. As the upper part of the door 3 faces the freezer compartment B, the temperature difference between this latter and compartment C is less than that in refrigerator cabinets of traditional type, in which the freezer door communicates directly with the outside. This increases the appliance efficiency, reducing energy consumption.

In the version of FIG. 2 the volume available for preservation (compartment A) is greater than that of the preceding version, namely by the difference in the volume of the two doors (3-2), the volume of compartment C being reduced correspondingly. This configuration also maintains the energy advantages of FIG. 1.

From the aforegoing the advantages of the invention are apparent, this teaching that by using common basic components (cabinet 1, doors 2, 3 and divider 4), two different refrigerator versions can be obtained. The term "common" does not however signify identical details, such as the number of shelves, sensors, box elements, containers, drawers, bottle carriers, flaps etc., with which the common components can be provided during refrigerator assembly. Likewise the dividers 4, although being identical as dividers and as hinge supports for the doors, can contain different equipment and control means. It should in any event be noted that the use of frontal dividers locatable in two different positions makes it possible for the electronic part to differently control the two refrigerator versions on the basis of the divider location. For example a proximity sensor, such as a reed or Hall sensor, can be used in the divider, together with a magnet in one of the baffles 6, 7, but not in the other. Locating the divider 5 on that baffle comprising the magnet determines a sensor "state" enabling a different type of control to be achieved from that if located on the other baffle.

The dimensioning of the described basic components can be chosen within wide limits provided it respects the interchangeability of doors of different dimensions (in height) on one and the same upright multi-compartment static cabinet.

We claim:

1. A method for varying the volume of a refrigerator cabinet into two different configurations, the method comprising the steps of:

a) providing each of the two configurations with a substantially equal static cabinet;

b) providing two deep doors attached to the cabinet of unequal height configured to outwardly close two end compartments and close an intermediate compartment positioned within the cabinet; and c) providing a frontal divider selectively fixable to the static cabinet in two different positions, wherein in one configuration an end compartment is increased in volume by its connection to the deep door of greater height and in the second configuration the other end compartment is increased in volume by its connection to the deep door of greater height.

2. The method of claim 1, further comprising the step of vertically superposing the three compartments.

3. The method of claim 1, further comprising the step of providing a control and display means, configured to operate the refrigerator, on the frontal divider.

4. The method of claim 1, wherein the compartments succeed each other from the top downwards in the following order: refrigeration compartment, freezer compartment and compartment for preservation at a higher temperature than the other two.

5. The method of claim 1, wherein the depth of the deep doors is at least 20% of that of the refrigeration compartment with its door closed.

6. The method of claim 1, further comprising the step of configuring the compartmnents to operate at different temperatures, the intermediate compartment being configured to operate at a lower temperature for freezing, and for preserving frozen products.

7. The method of claim 1, further comprising the step of providing the intermediate compartment with an auxiliary door that is covered by one of the two deep doors.

8. The method of claim 7, wherein the auxiliary door is hingedly connected to the intermediate compartment.

9. The method of claim 1, wherein the depth of the door is between about 30% and about 40% of the refrigeration compartment with its door closed.

10. The method of claim 1, further comprising the step of providing an insulated baffle between each of the compartments.

11. A method for varying the volume of a refrigerator cabinet into two different configurations, the method comprising the steps of:

a) providing each of the two configurations with a substantially equal static cabinet;

b) providing the cabinet with three compartments, a first compartment, a second compartment, and a third compartment;

c) providing two deep doors attached to the cabinet, a first door and a second door, of unequal height and volume, configured to outwardly close the three compartments, the first door having a greater height and volume than a second door and configured to close any two adjacent compartments and the second door being configured to close the other compartment; and d) providing a frontal divider selectively fixable to the static cabinet in two different positions; wherein in a first position, the first door closes the second and third compartments and the second door closes the first compartment such that the volume of the third compartment is increased by the volume relative to the first door, and in a second position, the second door closes the third compartment and the first door closes the first and second compartments such that the volume of the first compartment is increased by the volume relative to the first door.

12. The method of claim 11, further comprising the step of arranging the compartments in a stacked arrangement with the first compartment being positioned above the second compartment and the second compartment being positioned above the third compartment.

13. The method of claim 11, further comprising the step of configuring the first compartment with a temperature ranging from about 0 degrees Celsius to about 3 degrees Celsius.

14. The method of claim 11, further comprising the step of configuring the second compartment with a temperature of less than about −18 degrees Celsius.

15. The method of claim 14, further comprising the step of providing an auxiliary door configured to cover at least a portion of the second compartment and positioned internal to the first door, such that the second compartment is covered by the auxiliary door, which is covered by the first door.

16. The method of claim 15, wherein the auxiliary door is hingedly connected to the second compartment and is configured to rotate about a horizontal axis.

17. The method of claim 14, further comprising the step of providing control and display means, configured to operate the refrigerator, on the frontal divider.

18. The method of claim 11, further comprising the step of configuring the third compartment with a temperature of about 5 degrees Celsius.

19. The method of claim 11, wherein the depth of the door is at least 20% of that of the refrigeration compartment with its door closed.

20. The method of claim 11, wherein the depth of the door is between about 30% and about 40% of the refrigeration compartment with its door closed.

* * * * *